US009118985B2

(12) United States Patent
Terwal

(10) Patent No.: US 9,118,985 B2
(45) Date of Patent: Aug. 25, 2015

(54) COMMUNICATION OF DIAGNOSTIC INFORMATION FROM SATELLITE TO HOST

(71) Applicant: Bose Corporation, Framingham, MA (US)

(72) Inventor: Remco Terwal, West Newton, MA (US)

(73) Assignee: Bose Corporation, Framingham, MA (US)

( * ) Notice: Subject to any disclaimer, the term of this patent is extended or adjusted under 35 U.S.C. 154(b) by 379 days.

(21) Appl. No.: 13/693,345

(22) Filed: Dec. 4, 2012

(65) Prior Publication Data

US 2014/0153726 A1 Jun. 5, 2014

(51) Int. Cl.
*H04R 29/00* (2006.01)
*H04R 3/00* (2006.01)

(52) U.S. Cl.
CPC ..... *H04R 3/00* (2013.01); *H04R 29/001* (2013.01); *H04R 2499/13* (2013.01)

(58) Field of Classification Search
None
See application file for complete search history.

(56) References Cited

U.S. PATENT DOCUMENTS

| | | | | |
|---|---|---|---|---|
| 4,276,443 | A * | 6/1981 | Meyers | 381/96 |
| 4,592,088 | A * | 5/1986 | Shimada | 381/96 |
| 5,042,070 | A * | 8/1991 | Linna et al. | 381/59 |
| 5,450,624 | A * | 9/1995 | Porambo et al. | 381/59 |
| 5,815,584 | A * | 9/1998 | Whitecar et al. | 381/86 |
| 7,680,284 | B2 * | 3/2010 | Lee et al. | 381/59 |
| 2004/0008848 | A1 * | 1/2004 | Krochmal et al. | 381/55 |
| 2004/0081324 | A1 * | 4/2004 | Lau et al. | 381/106 |
| 2006/0273855 | A1 | 12/2006 | Matsui et al. | |
| 2013/0211663 | A1 * | 8/2013 | Kirsch et al. | 701/32.7 |
| 2013/0294609 | A1 * | 11/2013 | Tackett | 381/56 |

FOREIGN PATENT DOCUMENTS

WO 2009134537 A2 11/2009

OTHER PUBLICATIONS

International Search Report and Written Opinion dated Feb. 13, 2014 for International Application No. PCT/US2013/072031.
"Car-HiFi", Feb. 16, 2012, XP055100374, Retrieved from the Internet URL: http://upload.wikimedia.org/wikibooks/de/archive/4/4d/20130102080556!Car-HiFi.pdf [retrieved on Feb. 5, 2014] sections 2.5, 2.6, 2.7.5, 2.8.2, 2.8.3.

* cited by examiner

*Primary Examiner* — Thang Tran

(57) ABSTRACT

A vehicle sound system includes a subwoofer system having a subwoofer, a satellite amplifier for driving the subwoofer, a host amplifier for receiving an audio signal, a noise management processing unit for providing, to the host amplifier, information to be used for achieving a desired audio environment, a sensor for providing information to the noise management processing unit concerning the ambient audio environment, a control line between the satellite amplifier and the host amplifier for transmission of control signals to the satellite amplifier, and a signal line between the satellite amplifier and the host amplifier for transmission of audio signals to the satellite amplifier, the satellite controller being configured to cause a diagnostic signal to be placed on the control line, the diagnostic signal being indicative of an operating condition of the subwoofer system.

9 Claims, 3 Drawing Sheets

COMMUNICATION OF DIAGNOSTIC INFORMATION FROM SATELLITE TO HOST

FIELD OF DISCLOSURE

This disclosure relates to vehicle sound systems, and in particular, to communication between amplifiers in such a vehicle sound system.

BACKGROUND

Modern vehicle sound systems include speakers disposed at strategic locations within the vehicle. A host amplifier that receives an audio signal from a head unit, such as a CD player, a radio, or other audio source, drives these speakers.

Many vehicle sound systems also include a subwoofer specifically to provide bass. This subwoofer draws on considerably more power than the other speakers. As a result, in many vehicle sound systems, the subwoofer has its own separate amplifier, often called the "satellite amplifier."

Components of vehicle sound systems often include diagnostic subsystems. These diagnostic subsystems enable a component to communicate its operating condition to another component. This allows that other component to compensate, or adjust its own operation accordingly. In typical applications, a satellite amplifier will communicate its operating condition to the host amplifier that drives it.

Although it is straightforward for an amplifier to receive diagnostic information from those speakers that it drives, it is far more difficult to receive diagnostic information from speakers other than those that it directly drives. In particular, in a multi-amplifier sound system, a difficulty can arise in communicating diagnostic information from the satellite amplifier to the host amplifier.

SUMMARY

The invention is based on the recognition of the possibility of communicating diagnostic information from a satellite amplifier to a host amplifier using an existing cable that is already in use by the host amplifier to control the on/off state of the satellite amplifier. This avoids the need to provide an additional communication system dedicated to diagnostic information.

In one aspect, the invention features an apparatus for controlling an ambient audio environment. Such an apparatus includes a vehicle sound system including a subwoofer system having a subwoofer, a satellite amplifier for driving the subwoofer, a host amplifier for receiving an audio signal, a noise management processing unit for providing, to the host amplifier, information to be used for achieving a desired audio environment, a sensor for providing information to the noise management processing unit concerning the ambient audio environment, a control line between the satellite amplifier and the host amplifier for transmission of control signals to the satellite amplifier, and a signal line between the satellite amplifier and the host amplifier for transmission of audio signals to the satellite amplifier, the satellite controller being configured to cause a diagnostic signal to be placed on the control line, the diagnostic signal being indicative of an operating condition of the subwoofer system.

Some embodiments also include additional speakers connected to be driven by the host amplifier.

Embodiments differ in the diagnostic signal. In some embodiments, the satellite controller is configured to generate, as a diagnostic signal, a pulse width modulated signal, whereas in others, the satellite controller is configured to generate, as a diagnostic signal, a pulse code modulated signal. In yet others, the satellite controller is configured to generate a diagnostic signal having a duty cycle that indicates a particular operating condition of the subwoofer system. In others, the diagnostic signal is indicative of an operating condition selected from a plurality of operating conditions of the subwoofer system.

Some embodiments also include diagnostic circuitry for determining an operating condition of the subwoofer system. Among these are those that include a register for storing information indicative of the operating condition.

In other embodiments, the satellite controller is configured to impress the diagnostic signal on the control line only during selected diagnostic intervals interspersed between listening intervals. In those cases where the diagnostic signal has a duty cycle, the listening interval can include the time during which the diagnostic signal is not active. Thus, the lower the duty cycle, the longer the listening interval becomes.

The signal can be created in a variety of ways. One way is to provide a pull-up transistor between the control line and a DC bus, and to provide a satellite controller with an output connected to a gate of the pull-up transistor. Another way is to provide a transistor connected to the control line, and to have the satellite controller with an output connected to a gate of the transistor.

Other embodiments include a motor vehicle for supporting and providing power to the vehicle sound system. Examples of motor vehicles include passenger cars, trucks, and the like.

In another aspect, the invention features a method of communicating between a host amplifier and a satellite amplifier in a vehicle sound system. Such a method includes, at the satellite amplifier, receiving a control instruction from the host amplifier via a communication link; receiving, from a subwoofer system, diagnostic information indicative of an operating condition of the subwoofer system, based on the information, generating a diagnostic signal indicative of the operating condition, and transmitting the diagnostic signal to the host amplifier on the communication link.

In some practices of the invention, generating a diagnostic signal includes generating a signal that is modulated in a manner that depends upon the information indicative of an operating condition. In others, generating a diagnostic signal includes generating a pulse width modulated signal having a duty cycle indicative of an operating condition.

Other practices of the invention include determining that the communication link is in one of a diagnostic interval and a listening interval.

Yet other practices are those in which transmitting the diagnostic signal includes commencing transmission of the diagnostic signal in response to detecting commencement of a diagnostic interval.

Additional practices include, at the host amplifier, carrying out a noise reduction algorithm based at least in part on the diagnostic signal received from the satellite amplifier.

In yet another aspect, the invention features an apparatus for generating a sound field within a vehicle. Such an apparatus includes a satellite amplifier, a host amplifier, a communication link between the satellite amplifier and the host amplifier for transmitting control instructions from the satellite amplifier to the host amplifier, and means for transmitting, on the communication link, diagnostic information indicative of an operating condition of a subwoofer system driven by the satellite amplifier.

In some embodiments, the means for transmitting includes means for generating a modulated signal having a duty cycle indicative of an operating condition of the subwoofer system.

Other embodiments also include means for causing the diagnostic signal to be transmitted only during a diagnostic interval.

These and other features of the invention will be apparent from the following detailed description and the attached figures, in which:

DETAILED DESCRIPTION

Figure 1:
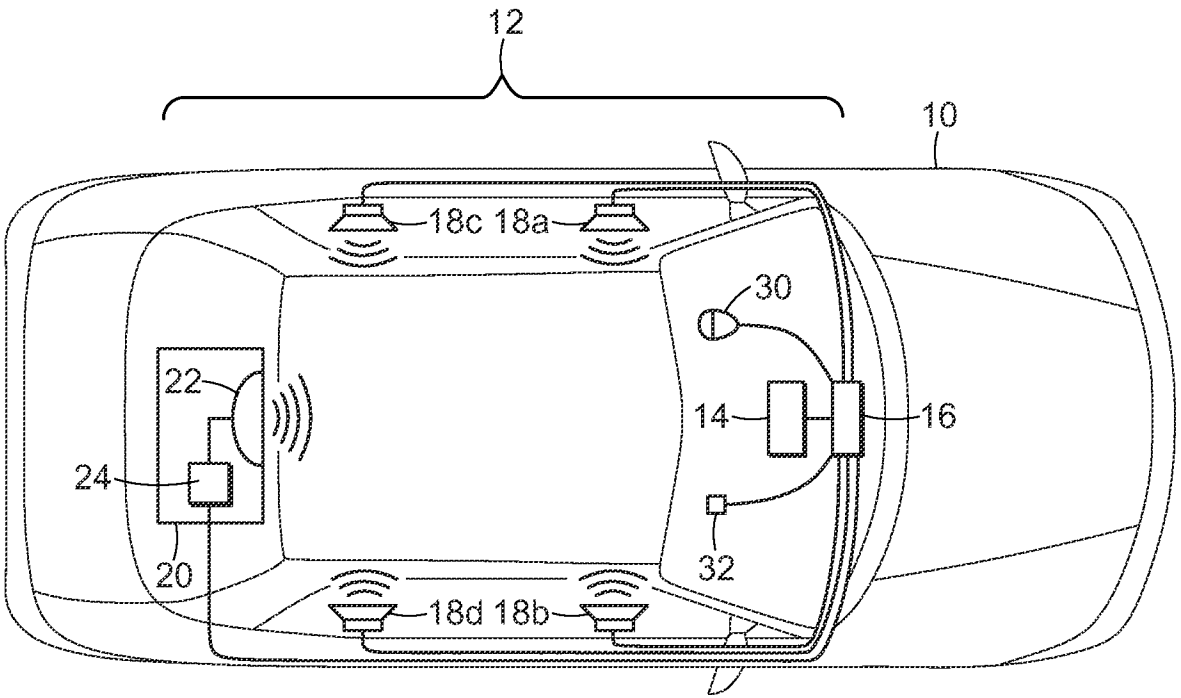
FIG. 1 shows a vehicle having a vehicle sound system installed therein.

FIG. 1 depicts a vehicle 10 having a vehicle sound system 12 installed therein. The sound system 12 includes a head unit 14 in communication with a host amplifier 16. The host amplifier 16 receives an audio signal from the head unit 14, amplifies it, and provides the resulting amplified audio signal to each of a plurality of speakers 18*a*-18*d*.

The host amplifier 16 also provides the audio signal to a subwoofer system 20. The subwoofer system 20 includes a subwoofer 22 that requires considerable power to drive. As a result, the subwoofer system 20 includes a separate satellite amplifier 24 to drive the subwoofer 22.

Figure 2:
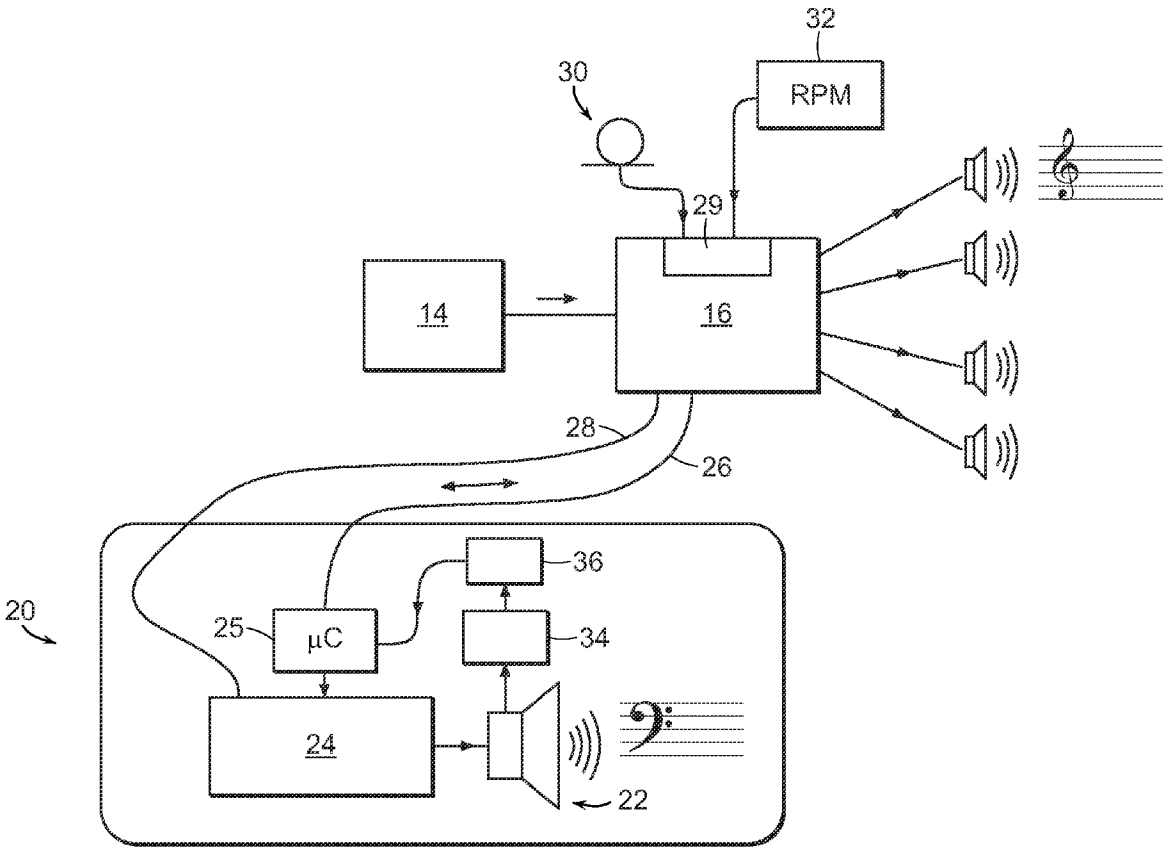
FIG. 2 shows additional details of the vehicle sound system depicted in FIG. 1.

Referring to FIG. 2, the host amplifier 16 connects to the satellite controller 25 via a control line 26 and an audio line 28. Control signals that cause the satellite controller to turn on or off travel to a satellite controller 25 within the satellite amplifier 24 via the control line 26, and audio signals travel to the satellite amplifier 24 via the audio line 28.

The host amplifier 16 also includes a noise management processing unit 29 that receives information indicative of the ambient sound environment within the vehicle 10. This information includes direct information, such as that obtained from microphones 30 strategically placed within the vehicle 10, and indirect information, such as that provided by, for example, an engine-speed indicator 32. Using this information, the noise management processing unit 29 implements a noise management algorithm, the output of which provides the host amplifier 16 with a basis for controlling the output of each of the speakers 18*a*-18*d* and the subwoofer 22 to achieve a desired audio environment. The resulting system is thus a closed-loop feedback system whose function is to maintain a particular audio environment by controlling outputs of multiple speakers 18*a*-18*d* and the subwoofer 22.

In some cases, because of a malfunction, a subwoofer 22 may not sound even if driven by the satellite amplifier 24. This can pose a difficulty for the feedback control system. For example, the host amplifier 16 may determine, based on its measurements of the vehicle audio environment, that more low frequency content is required. In that case, either the host amplifier 16 or the noise management unit 29 may instruct the satellite controller 25 to increase the volume of the subwoofer 22. Since the subwoofer 22 is malfunctioning, the host amplifier 16 would detect no change in the audio environment. The host amplifier 16, not realizing this, would assume that the subwoofer 22 is not being driven loudly enough. It would then instruct the satellite amplifier 25 to provide more power. These continued attempts to sound a broken subwoofer with ever increasing power demands would tend to destabilize the closed-loop control system. This could damage the satellite amplifier 25. In addition, the resulting disruption in the ambient audio environment could so startle the driver as to cause an accident.

To avoid this difficulty, the vehicle sound system 12 includes a mechanism for communicating diagnostic information concerning the operating condition of the subwoofer system 20 to the host amplifier 16.

The subwoofer 22 includes a diagnostic subsystem 34 that periodically measures the subwoofer's various electrical characteristics. Based on those characteristics, the diagnostic subsystem 34 identifies the operating condition of the subwoofer 22 and provides information concerning the operating condition of the subwoofer 22 in a condition register 36. The subwoofer 22 can be in any one of a number of operating conditions, each of which would have a corresponding entry in the condition register 36. These operating conditions range from normal operating conditions to conditions associated with different types of malfunctions.

A suitably programmed satellite controller 25 retrieves information from the condition register 36 via an $I^2C$ ("inter-integrated circuit) link. However, any other physical communication method can be used. For example, the information from the condition register 36 can also be retrieved via SPI.

The satellite controller 25 then looks up a duty cycle corresponding to that operating condition. This duty cycle is then used to generate a corresponding modulated diagnostic signal for communication back to the host amplifier 16. This diagnostic signal is placed on the same control line 26 that is used to communicate on/off instructions from the host amplifier 16 to the satellite controller 25.

Figure 3:
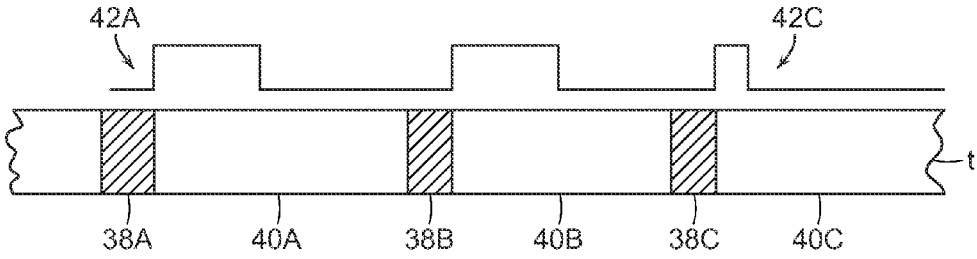
FIG. 3 shows a timing diagram for the vehicle sound system depicted in FIGS. 1 and 2.

To avoid conflict between the diagnostic signal and any control signal, the satellite controller 25 is programmed to check for a control signal only during periodically occurring listening intervals 38A-38C, as shown in FIG. 3. In some cases, the temporal extent of these listening intervals depends on the duty cycle, with a higher duty cycle leading to a shorter listening interval. In other cases, the temporal extent of a listening interval is a fixed value. Between these listening intervals 38A-38C are diagnostic intervals 40A-40C during which the satellite controller 25 uses the control line 26 to communicate diagnostic information back to the host amplifier 16.

As shown in FIG. 3, during the first diagnostic interval 40A, the subwoofer 22 is in an operating condition that is different from that in the third diagnostic interval 40C. This is apparent from the differing duty cycles associated with corresponding first and third portions 42A, 42C of the diagnostic signal.

As a result of the foregoing procedures, the control line 26, which is typically dedicated to providing control signals to the satellite controller 25, has been re-purposed to also provide diagnostic information back to the host controller 16. This eliminates the need to provide an independent communication system dedicated to providing diagnostic information from the subwoofer system 20 back to the host amplifier 16. The resulting vehicle sound system 12 thus requires fewer components, and is less costly to manufacture. In particular, the systems and methods described herein provide a way to avoid complicated high overhead communication schemes such as RS485, LIN (local interconnect network), CAN, and the like.

Figure 4:
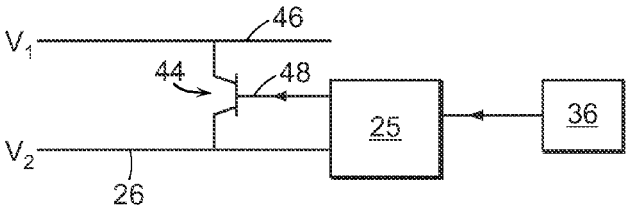
FIG. 4 shows a particular implementation of the vehicle sound system depicted in FIGS. 1 and 2.

In one implementation, shown in FIG. 4, the diagnostic signal is created by providing a pull-up transistor 44 connected between the control line 26 and a DC bus 46 and selectively deactivating the transistor 26 to remove the pull-up voltage from the line. A diagnostic output 48 of the satellite controller 25 connects to the gate of the pull-up transistor 44.

In operation, at the onset of a diagnostic interval, the satellite controller 25 inspects the table 36 to determine the duty cycle corresponding to a current condition of the subwoofer 22. The satellite controller 25 then impresses a modulated signal on the diagnostic output, which then causes a diagnostic signal to be impressed on the control line 26. Such a modulated signal can be a pulse width modulated signal or a pulse code modulated signal.

At the onset of the listening interval 38A, the satellite controller 25 impresses a gate signal at the diagnostic output 48 to remove the pull up transistor 44 from the circuit, thus allowing the satellite controller 25 to listen for a control signal from the host amplifier 16. This occurs until the onset of a new diagnostic interval 40B.

In the embodiment shown in FIG. 3, the diagnostic signal shuttles between a base-line voltage on the control line 26 and a higher voltage on the DC bus 46. However, in other embodiments, the diagnostic signal instead shuttles between ground and the base-line voltage on the control line 26.

To further avoid confusion, the voltage levels of the diagnostic signal are chosen to be different from the voltage levels of the control signal. For example, in one embodiment, the control signals are between ground and a medium voltage, and the diagnostic signals are between the medium voltage and a high voltage.

A suitable host amplifier 24 is the TDF8599 manufactured by NXP semiconductors of Eindhoven, in the Netherlands. However, any automotive amplifier integrated circuit with diagnostic capabilities can also be used. A suitable controller 25 is the PIC16LF1824, manufactured by Microchip Technology, Inc. of Chandler, Ariz., which is a reliable 14-pin microcontroller having multiple analog inputs, a low sleep current, and a reliable power-on reset circuit. However, any low-cost microcontroller with similar capabilities can also be used.

Having described the invention, and a preferred embodiment thereof, what is claimed as new, and secured by Letters Patent is:

1. An apparatus for controlling an ambient audio environment, said apparatus comprising:

(A) a vehicle sound system comprising:

(i) a subwoofer system comprising:

(a) a subwoofer;

(b) a satellite amplifier for driving said subwoofer;

(c) a satellite controller within said satellite amplifier;

(d) a register, connected to said satellite controller, for storing information indicative of an operating condition of said subwoofer and for providing said information indicative of said operating condition to said satellite controller; and (e) a diagnostic subsystem, connected to said register, for identifying said operating condition of said subwoofer and for providing said information concerning said operating condition to said register;

(ii) a host amplifier for receiving an audio signal;

(iii) a noise management processing unit for providing, to said host amplifier, information to be used for achieving a desired audio environment (iv) a sensor for providing information to said noise management processing unit concerning said ambient audio environment;

(v) a control line between said satellite controller and said host amplifier for transmission of control signals to said satellite, controller; and (vi) a signal line between said satellite amplifier and said host amplifier for transmission of audio signals to said satellite amplifier, said satellite controller being configured to cause a diagnostic signal to be placed on said control line, said diagnostic signal being indicative of said operating condition of said subwoofer.

2. The apparatus of claim 1, further comprising additional speakers connected to be driven by said host amplifier.

3. The apparatus of claim 1, wherein said satellite controller is configured to generate, as said diagnostic signal, a pulse width modulated signal.

4. The apparatus of claim 1, wherein said satellite controller is configured to generate, as said diagnostic signal, a pulse code modulated signal.

5. The apparatus of claim 3, wherein said satellite controller is configured to generate a diagnostic signal having a duty cycle that indicates a particular operating condition of said subwoofer system.

6. The apparatus of claim 1, wherein said diagnostic signal is indicative of an operating condition selected from a plurality of operating conditions of said subwoofer system.

7. The apparatus of claim 1, further comprising a DC bus; and a pull-up transistor between said control line and said DC bus, and wherein said satellite controller comprises an output connected to a gate of said pull-up transistor.

8. The apparatus of claim 1, further comprising a transistor connected to said control line, and wherein said satellite controller comprises an output connected to a gate of said transistor.

9. The apparatus of claim 1, further comprising a motor vehicle for supporting and providing power to said vehicle sound system.

* * * * *